US008430973B2

(12) United States Patent
Böhme et al.

(10) Patent No.: US 8,430,973 B2
(45) Date of Patent: Apr. 30, 2013

(54) METHOD FOR THE THERMOCHEMICAL PASSIVATION OF STAINLESS STEEL

(75) Inventors: Olaf Böhme, Erding (DE); Siegfried Piesslinger-Schweiger, Vaterstetten (DE)

(73) Assignee: Poligrat GmbH, München (DE)

( * ) Notice: Subject to any disclaimer, the term of this patent is extended or adjusted under 35 U.S.C. 154(b) by 731 days.

(21) Appl. No.: 12/529,858

(22) PCT Filed: Feb. 22, 2008

(86) PCT No.: PCT/EP2008/001419

§ 371 (c)(1),
(2), (4) Date: Dec. 30, 2009

(87) PCT Pub. No.: WO2008/107082

PCT Pub. Date: Sep. 12, 2008

(65) Prior Publication Data

US 2010/0132844 A1 Jun. 3, 2010

(30) Foreign Application Priority Data

Mar. 5, 2007 (DE) ..... 10 2007 010 538

(51) Int. Cl.
*C23C 22/50* (2006.01)

(52) U.S. Cl.
USPC ..... 148/287; 148/250; 148/259; 148/260; 148/271; 148/274; 148/283; 106/14.12; 106/14.13; 106/14.15; 106/14.41; 106/14.42; 106/14.43

(58) Field of Classification Search ..... 148/276–277, 148/284–287, 250, 259, 260, 271, 274, 283; 106/14.12, 14.13, 14.15, 14.41, 14.42, 14.43
See application file for complete search history.

(56) References Cited

U.S. PATENT DOCUMENTS

| | | | | |
|---|---|---|---|---|
| 5,354,383 | A | 10/1994 | Bianchi | |
| 6,120,619 | A | 9/2000 | Goudiakas et al. | |
| 2006/0266287 | A1 | 11/2006 | Parent et al. | |
| 2009/0120457 | A1 * | 5/2009 | Naghshineh et al. | 134/2 |

FOREIGN PATENT DOCUMENTS

| | | | |
|---|---|---|---|
| DE | 3991748 | C2 | 10/1991 |
| DE | 9214890 | U1 | 2/1993 |
| EP | 0596273 | A1 | 5/1994 |

(Continued)

OTHER PUBLICATIONS

M. J. Carmezim et al. "Improving the passivating efficiency of conversion films on stainless steel by thermal treatment," Thin Solid Films, Elsevier-Sequoia S. A. Lausanne, Ch, Mar. 15, 1995; vol. 258; No. 1/2; pp. 194-197.

(Continued)

*Primary Examiner* — Lois Zheng
(74) *Attorney, Agent, or Firm* — Westerman, Hattori, Daniels & Adrian, LLP

(57) ABSTRACT

The present invention relates to a process for improving the heat and corrosion resistance of stainless steel by means of a novel passivation process. This process comprises a chemical treatment with an aqueous solution comprising a complexing agent combination of at least one oxidant, a subsequent rinsing and a subsequent treatment at elevated temperature in an oxygen-containing atmosphere. The stainless steel surfaces obtained according to the invention have a homogeneous passive layer having increased chemical resistance and resistance to thermal discoloration.

15 Claims, 3 Drawing Sheets

1.4301

FOREIGN PATENT DOCUMENTS

| | | | |
|---|---|---|---|
| EP | 0769575 | A1 | 4/1997 |
| EP | 0776256 | B1 | 7/2005 |
| WO | 88/00252 | A1 | 1/1988 |
| WO | 98/22554 | A1 | 5/1998 |

OTHER PUBLICATIONS

"The passivation of steel," Technical Bulletin; No. 2005/17; Oct. 2005; pp. 1-2.

International Search Report of PCT/EP2008/001419, Mailing Date of Jun. 18, 2008.

Carmezim M. J. et al.; "Improving the passivating efficiency of conversion films on stainless steel by thermal treatment"; Thin Solid Films, vol. 258, 1995, pp. 194-197, XP004010918.

"The Passivation of Steel", Technical Bulletin No. 2005/17, Oct. 2005 pp. 1-3, XP002482878.

* cited by examiner

METHOD FOR THE THERMOCHEMICAL PASSIVATION OF STAINLESS STEEL

The present invention relates to a novel process for the passivation of stainless steel surfaces, which gives improved corrosion resistance of the treated surfaces and can also increase the resistance of these surfaces to thermal discoloration. The process comprises a chemical treatment with an aqueous solution comprising complexing agents, rinsing and subsequent thermal treatment in a gaseous, oxygen-containing atmosphere.

PRIOR ART

Steel which does not rust, frequently also referred to as stainless steel, is an iron alloy which can comprise iron together with a series of further elements such as chromium, nickel, molybdenum, copper and others. An important constituent of the stainless steel alloys whose treatment is the subject matter of the present invention is the element chromium which is present in a minimum concentration of about 13% by weight in order to ensure increased corrosion resistance of the steel. The chromium present in the alloy reacts at the surface with oxygen from the surroundings and forms an oxide layer on the surface of the material. From a chromium content of about 13% by weight of the alloy present in the workpiece concerned, the chromium oxide formed can reliably form a dense layer on the surface and thus protects the workpiece against corrosion. This protective layer is also referred to as a passive layer.

Such a passive layer is generally about 10 molecular layers thick and comprises, in addition to the chromium oxide, in particular iron oxide in a concentration of 10-55% by weight. The lower the portion of iron oxide in the passive layer, the higher the chemical resistance of the surface. Unless indicated otherwise, all percentages reported here are based on the total weight of the respective compositions of the stainless steel, the solutions, etc.

The corrosion resistance of the workpiece depends on the content of chromium and further alloying elements such as nickel and molybdenum. These further alloying elements are added to the stainless steel alloy in order to effect a further improvement in the corrosion resistance if the addition of chromium alone is not able to give the workpiece the desired degree of corrosion resistance or other features. However, these further elements which improve the corrosion resistance are expensive and thus increase the costs of production of the stainless steel to a not inconsiderable extent.

An alternative to the use of these expensive further elements is the formation of a very defect-free and dense passive layer having a very high ratio of chrome to iron in the passive layer on the surface of the stainless steel workpiece. Such a defect-free and dense passive layer is likewise able to increase the corrosion resistance of the workpiece significantly. To promote rapid formation of such a defect-free and dense passive layer, use is usually made of "passivation processes", i.e. the surfaces of the stainless steel workpieces are treated with oxidizing mediums. A common way to employ a treatment with diluted nitric acid or hydrogen peroxide or phosphoric acid, which is frequently carried out after pickling of the surface.

A further known measure for increasing the corrosion resistance is increasing the ratio of chromium to iron in the passive layer. One way of achieving this is, for instance, treatment of the surface with substances which have a high affinity for iron ions and are thus able selectively to leach iron ions from the passive layer and bind them. Aqueous solutions of complexing agents and/or chelating agents, for example citric acid, which, for instance, can increase the chromium/iron ratio on roller-smooth or ground stainless steel surfaces from a value of from 0.8 to 1.2 before the treatment to a value of from 3.0 to 5.0 after the treatment are frequently used for this purpose. This increased content of chromium oxide results in a correspondingly improved corrosion resistance of the workpiece.

These known measures described here make it possible to achieve improvements in the corrosion resistance of stainless steel workpieces, measured by means of the pit corrosion potential of these workpieces, from +100 mV to at best +400 mV compared to the initial state, as a function of the composition and the surface quality of the stainless steel treated and also the passivation processes used.

Apart from the corrosion resistance, the heat resistance of the stainless steel is frequently also important for its use. If stainless steel is heated in air above a critical temperature, the surface begins to discolor. This discoloration generally commences with a straw-yellow color which can go over into brown and blue shades at higher temperatures. The cause of this discoloration, also referred to as annealing/tempering color, is light interference at an oxide layer of increasing thickness. The critical temperature at which the discoloration commences depends on the respective alloy, the microstructure and the surface quality of the stainless steel workpiece. It is frequently in the range from about 160 to 180° C. and is higher, the higher the corrosion resistance of the stainless steel.

These thermally produced oxide layers are not only pleasant but they also have, compared to the genuine passive layers as described above, a considerably lower chemical resistance. Such thermally produced oxide layers reduce the corrosion resistance of the stainless steel to a considerable extent by either preventing the formation of genuine passive layers or displacing existing passive layers at relatively high temperatures.

It is therefore extremely important to clean the stainless steel surfaces of any thermally produced oxide layers present before use and to avoid the formation of such thermally produced oxide layers in operation.

The elimination of thermally produced oxide layers, e.g. the above-described annealing/tempering colors or scale, is in practice carried out either mechanically by particle blasting, grinding or brushing of the surface or chemically by pickling or electropolishing. However, no process which improves the resistance of stainless steel surfaces to thermal discoloration, i.e. to the formation of such thermally produced oxide layers, has hitherto been known in the prior art.

It is an object of the present invention to provide a process for the passivation of stainless steel surfaces, which compared to known passivation processes according to the prior art brings about a significant increase in the corrosion potential, measured as pit corrosion potential in accordance with DIN 50900. The increase in the corrosion potential which can be achieved by the processes described here is in the range from +500 mV to +850 mV compared to the initial state. It is thus possible in many cases to replace expensive molybdenum- or copper-containing materials with less expensive stainless steel grades which, owing to their passivation by means of a process according to the present invention, have the required corrosion resistance.

DESCRIPTION OF THE INVENTION

Figure 1:
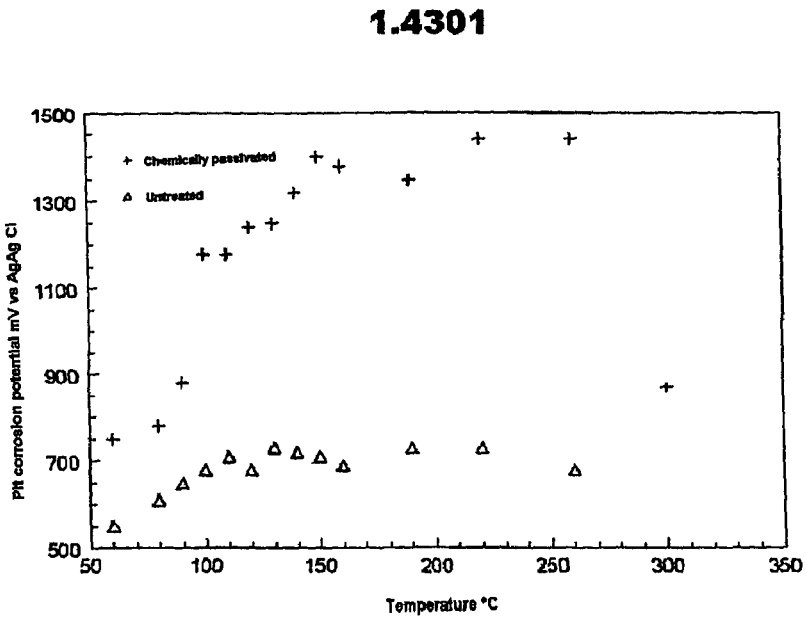
FIG. 1 shows the pit corrosion potential of untreated and chemically treated stainless steel of the grade 1.4301 after heat treatment at the temperatures indicated for 30 minutes in each case.

It has surprisingly been found that a targeted heat treatment of the surface in an oxygen-containing atmosphere enables the corrosion resistance of the stainless steel surface both of workpieces of stainless steel having a ferritic structure and those having an austenitic structure to be improved appreciably. This heat treatment in an oxygen-containing atmosphere will hereinafter frequently also be referred to as heat treatment or thermal treatment. The stainless steel workpiece is for this purpose heated at a temperature of at least 80° C. for a particular period of time. The upper limit to the temperature to be employed is given by the temperature at which thermally induced discoloration of the stainless steel surface commences and is different depending on the stainless steel grade used. If this upper limit to the temperature range is exceeded and a temperature range in which thermal discoloration of the stainless steel occurs is reached, the corrosion resistance of the treated workpiece drops again. With a suitable heat treatment, the pit corrosion potential in accordance with DIN 50900 can frequently be increased by from about +100 to +150 mV and even by up to about +200 mV and more.

It was likewise surprising that pretreatment of the stainless steel surfaces with an optimized aqueous passivating solution prior to this heat treatment can lead to a further, partially drastic increase in the pit corrosion potential. This pretreatment in an aqueous passivating solution will hereinafter frequently also be referred to as chemical treatment. Thus, for example, an increase in the pit corrosion potential by from +500 to +550 mV compared to the initial state was achieved in experiments on stainless steels of the grade 1.4016 (18% of chromium, ferritic microstructure) and subsequent heat treatment. In experiments on stainless steels of the grade 1.4301 (18% of chromium, 8% of nickel, austenitic microstructure) and subsequent heat treatment, it was even possible to achieve an increase in the pit corrosion potential by about +850 mV and more compared to the initial state. This increase in the corrosion resistance can thus even be above the values given by the sum of the increases in the pit corrosion potential resulting from the individual treatments, so that a synergistic effect of the chemical treatment and the thermal treatment can apparently be observed here.

The present invention thus provides a process for the passivation of stainless steel, in which the stainless steel is firstly subjected to a chemical treatment with an aqueous solution, subsequently rinsed with water and a heat treatment is then carried out. The aqueous solution used in the chemical treatment comprises at least one complexing agent combination and an oxidant. The complexing agent combination comprises compounds which are known to be able to complex iron ions in aqueous solution. The invention results from, in particular, the observation that only a combination of complexing agents is able to achieve a passivating effect which satisfies the objectives of the invention. Complexing agents are, in particular, hydroxycarboxylic acids, phosphonic acids and organic nitrosulfonic acids.

Preference is given to using polydentate complexing agents as complexing agents. These polydentate complexing agents can form chelate complexes with the iron ions and therefore contribute to effecting a further increase in the ratio of chromium oxide to iron oxide in the passive layer.

Examples of suitable complexing agents comprise, for instance, hydroxycarboxylic acids having 1, 2 or 3 hydroxyl groups and 1, 2 or 3 carboxyl groups and salts thereof. A particularly suitable example of such a hydroxycarboxylic acid is citric acid. A further suitable complexing agent is a phosphonic acid having the general structure $R'—PO(OH)_2$ where R' is a monovalent alkyl, hydroxyalkyl or aminoalkyl group, or a diphosphonic acid having the general structure $R''[—PO(OH)_2]_2$, where R" is a divalent alkyl, hydroxyalkyl or aminoalkyl group. In place of or in addition to these phosphonic acids and/or diphosphonic acids, it is also possible to use one or more salts of these phosphonic acids or diphosphonic acids. A particularly preferred example of such an acid is 1-hydroxyethane-1,1-diphosphonic acid (HEDP) or salts thereof. Further suitable complexing agents belong to the class of organic nitrosulfonic acids, i.e. nitroalkylsulfonic acids, nitroarylsulfonic acids, and salts thereof. A particularly preferred nitroarylsulfonic acid is meta-nitrobenzene sulfonic acid. In choosing the substituted or unsubstituted alkyl or aryl groups mentioned here or the carbon skeletons of the compounds, care has to be taken to ensure that the acid or the salt have sufficient solubility in the aqueous solution. For this reason, preference is given to the carbon chains, whether linear, branched, cyclic or aromatic, having not more than about 12 carbon atoms, in particular not more than 10 carbon atoms and most preferably not more than 6 carbon atoms.

A further essential constituent of the aqueous solution in the chemical treatment is an oxidant. This oxidant should preferably be able to ensure a standard potential of at least +300 mV in the solution. Suitable oxidants include, for example, nitrates, peroxo compounds, iodates and cerium (IV) compounds in the form of the respective acids or the corresponding water-soluble salts. Examples of peroxo compounds are peroxides, persulfates, perborates and percarboxylates such as peracetate. These oxidants can be used either alone or in the form of mixtures.

The term "stainless steel" as used here refers to iron alloys which have a chromium content of at least 13% by weight. Further elements which improve the corrosion resistance can be present in the alloy.

The chemical treatment according to the invention should not be confused with a conventional pickling process in which metal is removed intentionally from the surface of a metal workpiece (cf. DE 92 14 890 U1 and WO 88/00252 A1). The inventors of the present patent application presume that the particular effect of the process of the invention is attributable to a passive layer not being formed initially but instead an existing passive layer being altered in terms of its composition and structure by the sequence of process steps according to the invention. However, this is a theoretical assumption which cannot be considered to constitute a restriction to the present process.

The aqueous solutions can additionally comprise one or more wetting agents which reduce the surface tension of the aqueous solution. Examples of suitable wetting agents are, for instance, the nitroalkylsulfonic and nitroarylsulfonic acids described above under complexing agents and alkyl glycols having the general structure $H—(O—CHR—CH_2)_n—OH$, where R is hydrogen or an alkyl group having 1, 2 or 3 carbon atoms and n is preferably an integer from 1 to 5, for example 2 or 3; and other wetting agents.

A particularly suitable example of an aqueous solution which can be used in the first step of the treatment according to the present invention has the following composition:

- 0.5-10% by weight, in particular 3.0-5.0% by weight, of at least one hydroxycarboxylic acid having 1-3 hydroxyl groups and 1-3 carboxyl groups or a salt/salts thereof,
- 0.2-5.0% by weight, in particular 0.5-3.0% by weight, of at least one phosphonic acid having the general structure R'—$PO(OH)_2$ or a salt/salts thereof, where R' is a monovalent alkyl, hydroxyalkl or aminoalkyl group, and/or having the general structure R"[—$PO(OH)_2]_2$ or a salt/salts thereof, where R" is a divalent alkyl, hydroxyalkyl or aminoalkyl group,
- 0.1-5.0% by weight, in particular 0.5-3.0% by weight, of at least one nitroarylsulfonic or nitroalkylsulfonic acid or a salt/salts thereof,
- 0.05-1.0% by weight, in particular 0.1-0.5% by weight, of at least one alkyl glycol having the general structure H—$(O—CHR—CH_2)_n$—OH, where R is hydrogen or an alkyl group having 1-3 carbon atoms and n is 1-5, and
- 0.2-20% by weight, in particular 0.5-15% by weight, of an oxidant which is able to ensure a standard potential of at least +300 mV in the solution, where the remainder of the solution is water. The percentages indicated here relate to the respective pure substances or ions. If salts or compositions containing further substances, for instance counterions, water crystallization, solvents, etc. are used, correspondingly higher proportions by weight have to be used.

In a particularly preferred embodiment, the at least one hydroxycarboxylic acid comprises citric acid, and/or the at least one phosphonic acid or diphosphonic acid comprises HEDP, and/or the at least one nitroarylsulfonic or nitroalkylsulfonic acid comprises m-nitrobenzenesulfonic acid, and/or the at least one alkyl glycol comprises ethylene glycol and/or butyl glycol, and the oxidant comprises nitrate, peroxide, persulfate and/or cerium (IV) based ions, in each case in the weight ratios indicated above.

If appropriate, further wetting agents can be added in a concentration of from 0.02 to 2.0% by weight, preferably from 0.05 to 1.0% by weight, to the above composition. In addition, one or more thickeners can, if appropriate, be added to these compositions. These thickeners, for example kieselguhr, can serve to increase the viscosity of the solution. However, the chemical treatment in aqueous solution is preferably carried out in a dipping bath so that such thickeners can be dispensed with.

The aqueous solution preferably has a pH which is below 7, preferably below 4. This can be achieved by the aqueous solution containing at least one acid. A preferred process comprises adding at least one of the complexing agents and/or at least one of the oxidants at least partly in the form of an acid to the solution.

The first step of the treatment according to the present invention is, in a preferred embodiment, carried out in an aqueous solution having a temperature of not more than about 70° C. The treatment in aqueous solution is more preferably carried out at a temperature in the range from room temperature to 60° C. The chemical treatment in aqueous solution is preferably carried out for a period of at least 60 minutes; for example, the chemical treatment with an aqueous solution can be carried out over a period of 1-4 hours.

After the treatment with an aqueous passivating solution, the workpiece is rinsed with water, preferably deionized water, to remove the passivating solution and if desired dried before the workpiece is subjected to the heat treatment. This rinsing can be effected by spraying or by (if appropriate multiple) dipping into a dipping bath or by combinations of these rinsing processes.

The step of heat treatment is carried out at a temperature of at least 80° C. in an oxygen-containing atmosphere. The heat treatment is preferably carried out at a temperature in the range from 80° C. to 280° C., in particular at a temperature above 100° C. and not more than 260° C.

In a preferred embodiment, the oxygen-containing atmosphere in the thermal treatment can be air. In other embodiments of the present invention, the oxygen-containing atmosphere is, in particular, water vapor or a mixture of water vapor and air. Such an atmosphere containing water vapor is preferably used at a temperature of at least 100° C.

The optimal temperature range for the heat treatment depends substantially on the type of stainless steel to be treated. However, this optimal range can easily be determined by a person of average skill in the art by means of experiments.

For example, a suitable temperature is in the range from 100° C. to 270° C., preferably from 150° C. to 260° C., in particular from 220° C. to 260° C., when the stainless steel is an austenitic steel which has a content of about 16-20% by weight of chromium and about 7-10% by weight of nickel, for example stainless steel of the grade 1.4301 (cf. FIG. 1).

Figure 2:
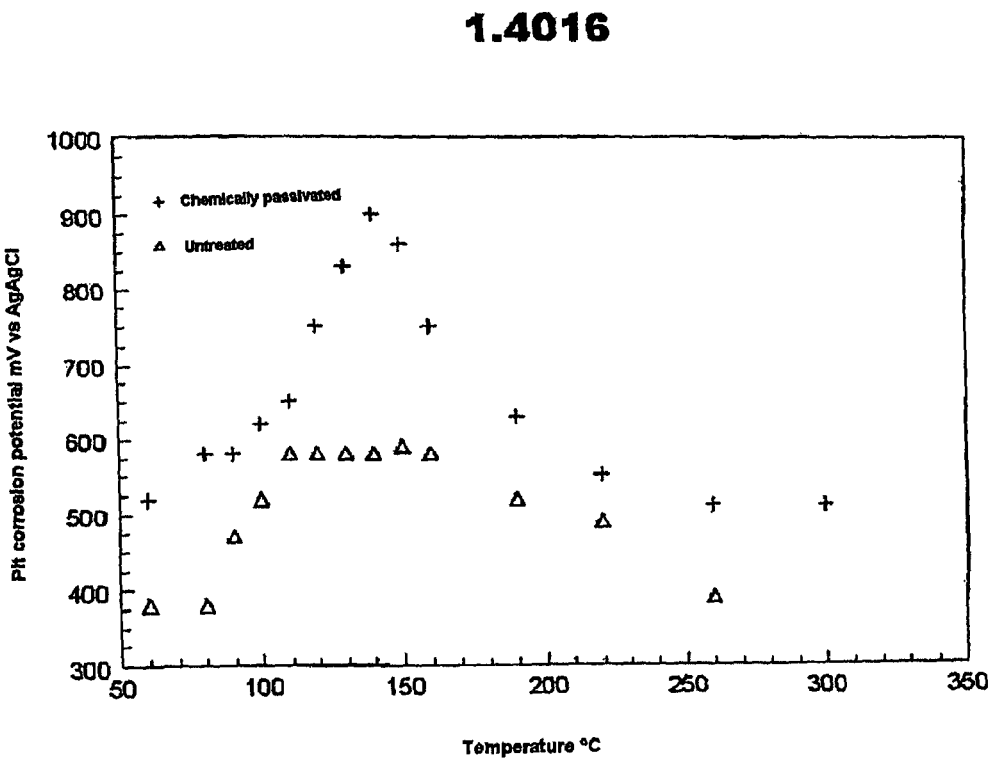
FIG. 2 shows the pit corrosion potential of untreated and chemically treated stainless steel of the grade 1.4016 after heat treatment at the temperatures indicated for 30 minutes in each case.

A stainless steel of the grade 1.4016 which has a chromium content of about 16-20% by weight and otherwise has essentially no further alloying constituents which increase the corrosion resistance, for instance nickel or molybdenum, gives good results when subjected to a heat treatment in which the temperature is in the range from 100° C. to 190° C., preferably from 120° C. to 160° C., in particular from 130° C. to 150° C. (cf. FIG. 2). The expression "essentially no" here means that the elements concerned are, if present at all, present in a concentration of less than 1% by weight, generally in the range from 0 to 0.1% by weight, in the alloy.

Figure 3:
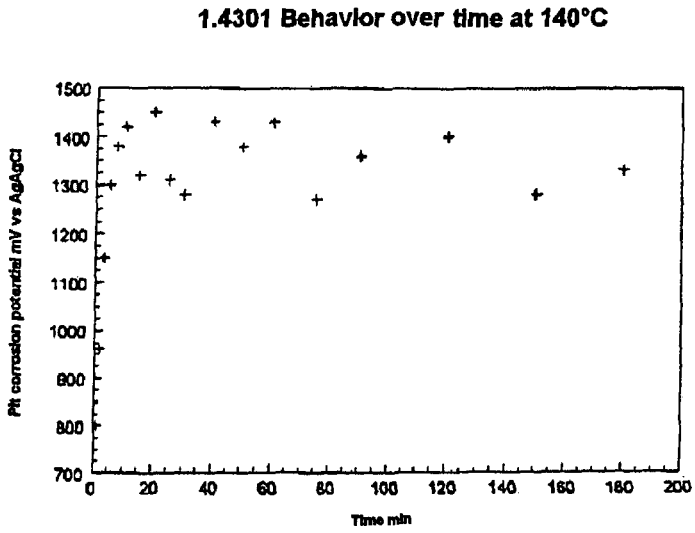
FIG. 3 shows the pit corrosion potential of stainless steel of the grade 1.4301 as a function of the time of a heat treatment at 140° C.

This heat treatment should be carried out for a period of at least 2 minutes (cf., for example, FIG. 3 for stainless steel of the grade 1.4301). The heat treatment is preferably carried out for a period of 15-45 minutes, for example for about 30 minutes. An thermal treatment which takes too long, for instance of more than several hours, may lead, depending on the stainless steel grade, to the corrosion resistance of the treated workpiece decreasing again.

Figure 4:
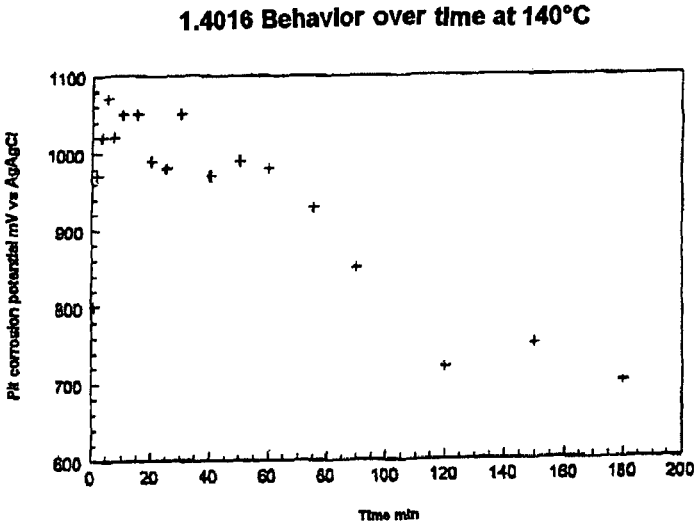
FIG. 4 shows the pit corrosion potential of stainless steel of the grade 1.4016 as a function of the time of a heat treatment at 140° C.

Thus, for example, a stainless steel of the grade 1.4016 firstly displays a rapid increase in the pit corrosion potential to values of about +1000 mV (cf. FIG. 4) when heated to 140° C., i.e. to a temperature which is in the optimal range for the heat treatment. However, if such a workpiece is subjected to this temperature for longer periods of time, the pit corrosion potential drops again to values of about +700 mV. For some types of stainless steel, it therefore has to be ensured that the heat treatment is not carried out for longer than about 90 minutes, preferably not longer than about 60 minutes.

A further important advantage of the process described here is that it is not only suitable for effecting a significant increase in the corrosion resistance, measured as pit corrosion potential in accordance with DIN 50900, compared to the initial state but the process is also suitable for increasing the resistance of stainless steel workpieces to thermal discoloration. Such an increase in the resistance of stainless steel workpieces or their surfaces to thermal discoloration during use by means of a passivation process has not been described hitherto and represents a further significant advantage of the invention described here.

The prior art discloses, inter alia, a process for the cleaning and passivation of a stainless steel surface, in which a hydroxyacetic acid or citric acid in aqueous solution is applied to the surface (cf. EP 0 776 256 B1). However, the content of hydroxycarboxylic acid in this process is significantly below 3.0% by weight. In addition, this prior art, which does not mention the thermal treatment of the workpiece, is more probably concerned with forming a passive layer on the workpiece surface, with the complexes used precipitating easily and being incorporated into the oxide film over the workpiece (cf. the abovementioned EP 0 776 256 B1). It is also worth mentioning DE 39 91 748 C2 which discloses, subsequent to an electrochemical prepolishing of a stainless steel material, the treatment of the polished surface by means of an oxidizing process in an oxidizing high-temperature gas atmosphere. The temperature of this process step is above 300° C. The process of the invention usually takes place at temperatures below 300° C.

The invention additionally provides an aqueous solution for carrying out a process according to the invention, wherein the aqueous solution comprises a complexing agent combination and contains 3.0-10% by weight of the abovementioned hydroxycarboxylic acid or acids as one of the complexing agents. In addition, this aqueous solution contains an oxidant as defined above. The complexing agent combination is, as explained in detail above, preferably formed by at least one hydroxycarboxylic acid, at least one phosphonic acid and at least one nitroarylsulfonic or nitroalkylsulfonic acid. The aqueous solution can, in particular, additionally contain an alkyl glycol.

The invention further provides a workpiece composed of metal having at least one stainless steel surface, which can be obtained by subjecting the workpiece to a process as described here.

The invention is illustrated by the following examples. However, these examples present only possible embodiments of the passivation process described here and in no way imply a restriction to these examples.

EXAMPLES

Example 1

Stainless Steel of the Grade 1.4301

Two 1.5 mm thick stainless steel sheets (A and B) of the grade 1.4301 having an austenitic microstructure and a content of 18% by weight of chromium and 8% by weight of nickel in the alloy, which had a cold-rolled and a smooth heat-treated surface, were degreased by means of alkali in the original state, rinsed clean with deionized water and dried. The pit corrosion potential was subsequently measured in accordance with DIN 50900. The pit corrosion potential in the initial state was +550 mV for both metal sheets.

Sheet B was subsequently dipped into a passivating solution having the following composition (in % by weight):

3.5% of citric acid
1.9% of m-nitrobenzensulfonic acid
3.0% of hydroxyethane diphosphonic acid (HEDP)
0.1% of butyl glycol
0.2% of wetting agent
22.1% of magnesium nitrate•$6H_2O$
to 100%: deionized water The chemical treatment was carried out at 40° C. for 180 minutes. The sheet was subsequently rinsed with deionized water and dried in air.

The pit corrosion potential of sheet B was then measured as +750 mV, an increase of +200 mV compared to the initial state.

The two sheets (A and B) were subsequently heated at 240° C. in an oven for 30 minutes. After cooling, the sheet B which had been treated in the passivating solution displayed no color change, while the untreated sheet A had acquired a straw-yellow color. The subsequent measurement of the pit corrosion potential gave the following results:

For the sheet a which had not been treated chemically:

+650 mV and thus an improvement of +100 mV compared to the initial state and a −100 mV lower value compared to the chemically treated sheet B before heat treatment of the latter.

For the chemically treated sheet B:

+1450 mV and thus an improvement of +900 mV compared to the initial state and of +700 mV compared to the value after dipping into the passivating solution and of +800 mV compared to the sheet A which had only been heat treated.

Example 2

Stainless Steel of the Grade 1.4016

Two 1.0 mm thick stainless steel sheets (C and D) of the grade 1.4016 having a ferritic microstructure and a content of 18% by weight of chromium in the alloy, which had a cold-rolled and a smooth heat-treated surfaces, were degreased by means of alkali, rinsed with deionized water and dried in air. The pit corrosion potential was then measured in the initial state in accordance with DIN 50900. It was +370 mV for both the sheets C and D.

Sheet D was subsequently treated in a passivating solution whose composition is described in example 1. The treatment was carried out at room temperature (+22° C.) for a time of 2.5 hours. The sheet was subsequently rinsed clean with deionized water, dried in air and the pit corrosion potential was measured as +520 mV, an increase of +150 mV compared to the initial state.

Both the sheets C and D were subsequently heated at 140° C. in an oven for a time of 30 minutes. After cooling, the two sheets displayed no color changes. Determination of the pit corrosion potential gave the following results:

For the sheet C which had not been treated chemically:

+570 mV and thus an improvement of +200 mV compared to the initial state and a +50 mV higher value compared to sheet D after it had been treated in the passivating solution.

For the chemically treated sheet D:

+900 mV and thus a +530 my higher value than that for the initial state and a +380 mV higher value than after treatment in the passivating solution and a +330 mV higher value than that measured for sheet C after the heat treatment.

Example 3

Stainless Steel of the Grade 1.4016

Two stainless steel sheets (E and F) of the grade 1.4016 were pretreated as in example 2 and the sheet F was treated in the passivating solution (for composition, see example 1). Both sheets were subsequently heated at 210° C. in an oven for a time of 30 minutes. After cooling, the sheet E which had not been treated in the passivating solution had a distinct straw-yellow color, while the sheet F displayed no color change.

The sheet E which had not been chemically treated:

The pit corrosion potential of sheet E was +480 mV and thus +110 mV higher than in the initial state but 90 mV below the value achieved in a thermal treatment in the optimal range (cf. example 2).

The sheet F which had previously been chemically treated:

The pit corrosion potential of sheet F was +520 mV and thus corresponded to the value measured before the heat treatment. However, this value is 380 mV below the pit corrosion potential of +900 mV determined after a treatment in the optimal temperature range, namely about +140° C. (cf. example 2, sheet D), although sheet F displayed no temperature-induced discoloration.

This example thus shows that the corrosion resistance decreases again when the temperature range which is optimal for a particular stainless steel grade is exceeded, but is still higher than before the passivating treatment.

The invention claimed is:

1. A process for the passivation of stainless steel, wherein the stainless steel is subjected firstly to a chemical treatment with an aqueous solution containing at least one polydentate complexing agent for iron and at least one oxidant, where the oxidant is able to ensure a standard potential of at least +300 mV in the solution, subsequently to a rinsing step with water and then to a heat treatment at a temperature of at least 80° C. in an oxygen-containing atmosphere, wherein the aqueous solution comprises:

(a) 0.5-10% by weight of at least one hydroxycarboxylic acid having 1-3 hydroxyl groups and 1-3 carboxyl groups or a salt/salts thereof, (b) 0.2-5.0% by weight of at least one phosphonic acid having a general structure R'—$PO(OH)_2$ or a salt/salts thereof, where R' is a monovalent alkyl, hydroxyalkyl or aminoalkyl group, and/or having a general structure R"[—$PO(OH)_2]_2$ or a salt/salts thereof, where R" is a divalent alkyl, hydroxyalkyl or aminoalkyl group, (c) 0.1-5.0% by weight of at least one nitroarylsulfonic or nitroalkylsulfonic acid or a salt/salts thereof, (d) 0.05-1.0% by weight of at least one alkyl glycol having a general structure H—(O—CHR—$CH_2$)—OH, where R is hydrogen or an alkyl radical having 1-3 carbon atoms and n is 1-5, and 0.2-20% by weight of the oxidant, where the remainder of the solution is water to which optionally one or more thickeners can also be added, wherein the at least one polydentate complexing agent comprises (a), (b) and (c).

2. The process as claimed in claim 1, wherein the oxidant comprises at least one compound selected from the group consisting of nitrate, peroxide, persulfate, perborate, the percarboxylates, iodate and cerium (IV) based compounds in the form of the respective acids and/or salts.

3. The process as claimed in claim 1, wherein the chemical treatment in the aqueous solution is carried out at a temperature of not more than 70° C.

4. The process as claimed in claim 1, wherein the chemical treatment in the aqueous solution is carried out for a period of 1-4 hours.

5. The process as claimed in claim 1, characterized in that the subsequent heat treatment is carried out in an air atmosphere, in a water vapor atmosphere or a mixture of air and water vapor.

6. The process as claimed in claim 1, characterized in that the subsequent heat treatment is carried out at a temperature in a range from 80° C. to 280° C.

7. The process as claimed in claim 6, characterized in that the temperature of the heat treatment is in a range from 100° C. to 270° C. when the stainless steel is an austenitic steel which has a content of 16-20% by weight of chromium and 7-10% by weight of nickel.

8. The process as claimed in claim 7, wherein the temperature of the heat treatment is in a range from 150° C. to 260° C.

9. The process as claimed in claim 6, characterized in that the temperature in the heat treatment is in a range from 100° C. to 190° C. when the stainless steel is a ferritic steel which has a chromium content of 16-20% by weight and contains essentially no nickel and/or molybdenum.

10. The process as claimed in claim 9, wherein the temperature in the heat treatment is in a range from 120° C. to 160° C.

11. The process as claimed in claim 1, characterized in that the subsequent heat treatment is carried out for a period of at least 2 minutes.

12. The process as claimed in claim 1, characterized in that the subsequent heat treatment is carried out for a period of 15-45 minutes.

13. The process as claimed in claim 1 wherein the corrosion resistance of the stainless steel surface is increased.

14. The process as claimed in claim 1 wherein the resistance to thermal discoloration of the stainless steel surface is increased.

15. The process according to claim 1, wherein the aqueous solution contains 3.0-10% by weight of the hydroxycarboxylic acid.

* * * * *